US005208931A

United States Patent [19]

Williams et al.

[11] Patent Number: 5,208,931

[45] Date of Patent: May 11, 1993

[54] LAUDRY MACHINES AND/OR METHODS OF CONTROLLING THE SAME

[75] Inventors: John Julian A. Williams; Frank W. Shacklock; David J. Ensor, all of Auckland, New Zealand

[73] Assignee: Fisher & Paykel Limited, Mt. Wellington, New Zealand

[21] Appl. No.: 573,799

[22] Filed: Aug. 28, 1990

[30] Foreign Application Priority Data

Aug. 30, 1989 [NZ] New Zealand ..... 230489

[51] Int. Cl.[5] ..... D06F 33/02

[52] U.S. Cl. ..... 8/159; 68/12.04; 68/23.7

[58] Field of Search ..... 68/207, 12 R, 13, 12.04, 68/23.7; 8/158, 157

[56] References Cited

U.S. PATENT DOCUMENTS

| | | | |
|---|---|---|---|
| 3,030,790 | 4/1962 | Davenport et al. | 68/12.04 |
| 3,359,766 | 12/1967 | Haas | 68/12.04 |
| 4,235,085 | 11/1980 | Torita . | |
| 4,303,406 | 12/1981 | Ross | 68/12 R X |
| 4,335,592 | 6/1982 | Torita | 68/12 R |
| 4,400,838 | 8/1983 | Steers | 68/12 R X |
| 4,607,408 | 8/1986 | Didier et al. | 68/12 R X |
| 4,741,182 | 5/1988 | Didier et al. | 68/12 R |
| 4,779,430 | 10/1988 | Thuruta et al. | 68/12.04 |
| 4,837,882 | 6/1989 | Brenner et al. | 68/23.7 |
| 4,862,710 | 9/1987 | Torita et al. | 68/12 R |

FOREIGN PATENT DOCUMENTS

| | | | |
|---|---|---|---|
| 143685 | 6/1985 | European Pat. Off. . | |
| 345120 | 12/1989 | European Pat. Off. | 68/12.04 |
| 263487 | 11/1986 | Japan | 68/12.04 |
| 63-161997 | 7/1988 | Japan | 68/12.04 |
| 2202332 | 9/1988 | United Kingdom . | |

*Primary Examiner*—Frankie L. Stinson

*Attorney, Agent, or Firm*—Jacobson, Price, Holman & Stern

[57] ABSTRACT

A method, control device and appartaus for providing a desired water level in a laundry machine (1) by energizing the motor (10) of the machine intermittently to produce changes in velocity of the spin tub (3), agitator (4) and a load of clothes in the spin tub. The changes in velocity are measured and from the measurements the mass of the load of clothes is determined. A desired volume of water necessary for an optimum wash of the load of clothes is then determined and this volume of water is admitted (17) to the washing container (2) of the laundry machine.

26 Claims, 6 Drawing Sheets

START
20
WATER ON
21
SLOW STIR
58
UPDATE LOAD MEASUREMENT
59
DECLUTCHED ?
60
NO
YES
IS LOAD MEASUREMENT EQUAL TO DESIRED LOAD MEASURE-MENT ?
61
NO
YES
WATER OFF
62
USE WATER LEVEL FROM INDICATOR OR LOAD MEASUREMENT TO SET WASH PROFILE.
63
START WASH
64

LAUDRY MACHINES AND/OR METHODS OF CONTROLLING THE SAME

FIELD OF THE INVENTION

This invention relates to laundry machines and/or methods of controlling the same.

BRIEF SUMMARY OF THE INVENTION

It is an object of the present invention to provide a laundry machine and/or methods of controlling the same.

In one aspect the invention consists in a method of providing a desired level of washing liquid in a laundry machine having a cabinet, a washing container within said cabinet, a rotatable assembly comprising a spin tub within said container and an agitator within said spin tub, and a motor driving said agitator conjointly with said spin tub or separately on disconnection of said spin tub from said agitator as required, and washing liquid level control means to control washing liquid level in said washing container, the method comprising the steps of placing a load of clothes in said spin tub, energizing said motor intermittently to cause changes in the rotational speed of said rotatable assembly, using sensing means to sense the changes in speed of said rotatable assembly relative to energy input to said motor to indicate the mass of clothes load in said spin tub passing signals from said sensing means to said liquid level control means so that said control means control the supply of washing liquid to said container to control the level of the washing liquid to a desired level which level is determined by said control means and is dependent on said mass of clothes load sensed by said sensing means.

In a further aspect the invention consists in control means for a laundry machine having a cabinet, a washing container within said cabinet, a rotatable assembly comprising a spin tub within said container and an agitator within said spin tub, and a motor driving said agitator conjointly with said spin tub or separately on disconnection of said spin tub from said agitator as required, and washing liquid admission means, said control means comprising sensing means to sense the changes in speed of said rotatable assembly including the mass of clothes load in said assembly relative to energy input to said motor, and washing liquid level control means arranged to control washing liquid level in said washing container in response to signals passed by said sensing means to said control means, the construction and arrangement being such that said washing liquid level control means causes the flow of washing liquid into said container to cease on said washing liquid reaching a desired level which is dependent on the mass of clothes load sensed by said sensing means.

In a further aspect the invention consists in a method of controlling a laundry machine having a cabinet, a washing container within said cabinet, a rotatable assembly comprising a spin tub within said container and an agitator within said spin tub, and a motor driving said agitator and spin tub when required, float means being provided to connect or disconnect said spin tub from said agitator according to the presence or absence of a sufficient quantity of washing liquid in said container, said method comprising the steps of intermittently energizing said motor to cause said assembly to rotate at a slow rate with changes in speed of rotation, sensing changes of kinetic energy in the assembly during changes of speed of rotation thereof after a load of clothes has been placed in said spin tub and before or during the supply of water into said container in order to ascertain the mass of said load, storing information as to the size of said load, sensing disconnection by said float means of said agitator from said spin tub, storing information on the changes in kinetic energy and information storage means, and using the stored information to provide routines selected from giving an indication of a wash profile requested for the sensed load of clothes to be washed and to control the washing routine to give a desired degree of wash to the clothes; and determining the level of water required for that load of clothes, cutting off the supply of water to said container and causing the wash routine to start.

In a still further aspect the invention consists in a laundry machine comprising a cabinet, a washing container within said cabinet, a rotatable assembly comprising a spin tub within said container and an agitator within said spin tub, and a motor driving said agitator and spin tub when required, washing liquid admission means, float means being provided to connect or disconnect said spin tub from said agitator and said motor according to the presence or absence of a sufficient quantity of washing liquid in said cotainer, sensing means to sense changes of kinetic energy responsive to changes in the speed of rotation of said rotatable assembly in said assembly during changes in speed of rotation thereof, information storage means adapted to store signals from said sensing means which are a measure of said changes in kinetic energy, washing liquid level control means arranged to control washing liquid level in said washing container and/or wash routine control. means arranged to control the wash routine of the laundry machine to give a desired vigorousness of wash according to settings determined by said signals from said sensing means.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

The invention consists in the foregoing and also envisages constructions of which the following gives examples only.

BRIEF DESCRIPTION OF THE DRAWINGS

One preferred form of the invention will now be described with reference to the accompanying drawings, in wherein.

DETAILED DESCRIPTION

Figure 1:
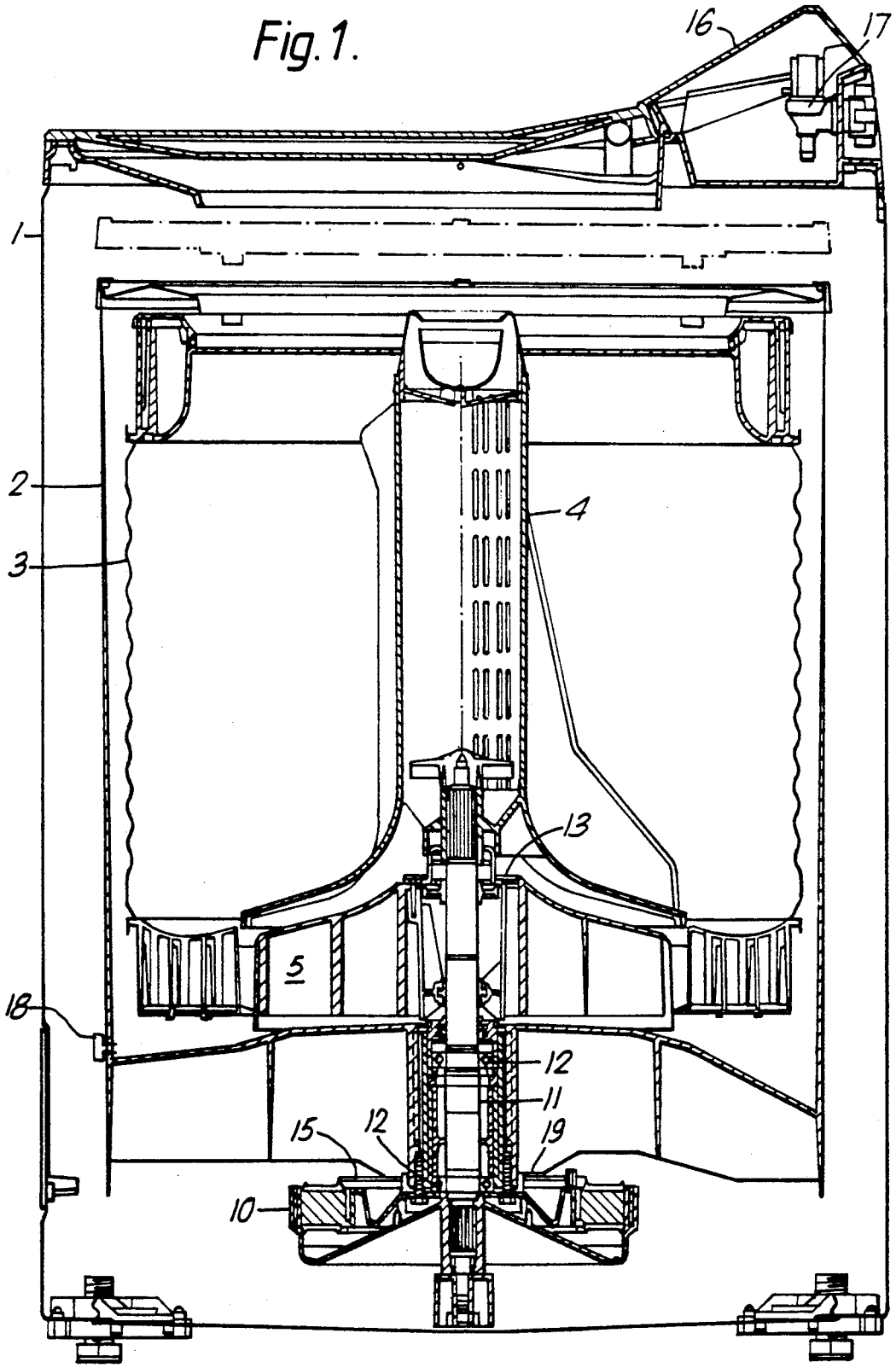
FIG. 1 is a vertical cross-sectional view of one form of laundry machine to which the invention is applicable.

Referring to the drawings, FIG. 1 illustrates a cross section of a preferred form of laundry machine, a full description of which appears in published U.S. Pat. No. 4,813,248 and the description of that laundry machine in that patent is incorporated herein by reference.

For the purposes of the present invention the laundry machine comprises a cabinet 1 within which there is a fixed container 2 and within that container is a rotatable spin tub 3 and within the spin tub is an agitator 4. An interengagement mechanism is provided to enable the spin tub 3 and the agitator 4 to be raised and lowered when washing liquids hereinafter referred to as water enters the container 1 and such mechanism includes an air chamber shown generally by the reference 5 and is described in the above patent. The agitator 4 is driven by an electronically commutated motor 10, driving a shaft 11 carried in bearings 12. This construction is fully described in the above patent which is incorporated herein by reference, including a reference to parts of a dog clutch or inter engagement mechanism 13.

A control means 15 is provided preferably associated with the stator of the motor 10 and such control means include starting means arranged so that on appropriate operation of manually operable controls in a console 16 by an operator, starting up of a washing cycle is commenced and water is admitted into the container 2 through a valve 17. Motor controls 19 including sensing means to sense changes in speed and energy input to said rotatable assembly are also provided and the sensing means pass signals indicating these parameters to the control means.

The washing machine has washing liquid level detection means which comprise the spin tub 3, the disengagement of which from the agitator which is caused by its floating and the air chamber in liquid in the container disengaging the parts of the dog clutch mechanism 13 and also lifts the spin tub 3 and this is sensed by sensing means. The washing machine container 2 also has an auxiliary washing liquid level detection means comprising for example a pressure transducer 18 which provides the control means 15 with a signal indicative of the level of water in the container 2.

It has been found that there are three main methods by which the control means may determine the load in a washing machine and therefore control the supply of water or washing liquid to the level which provides the most effective wash performance.

In each method, the operator places a load e.g. of clothes in the spin tub 3 and appropriately operates the manual controls to give a desired wash.

Figure 2:
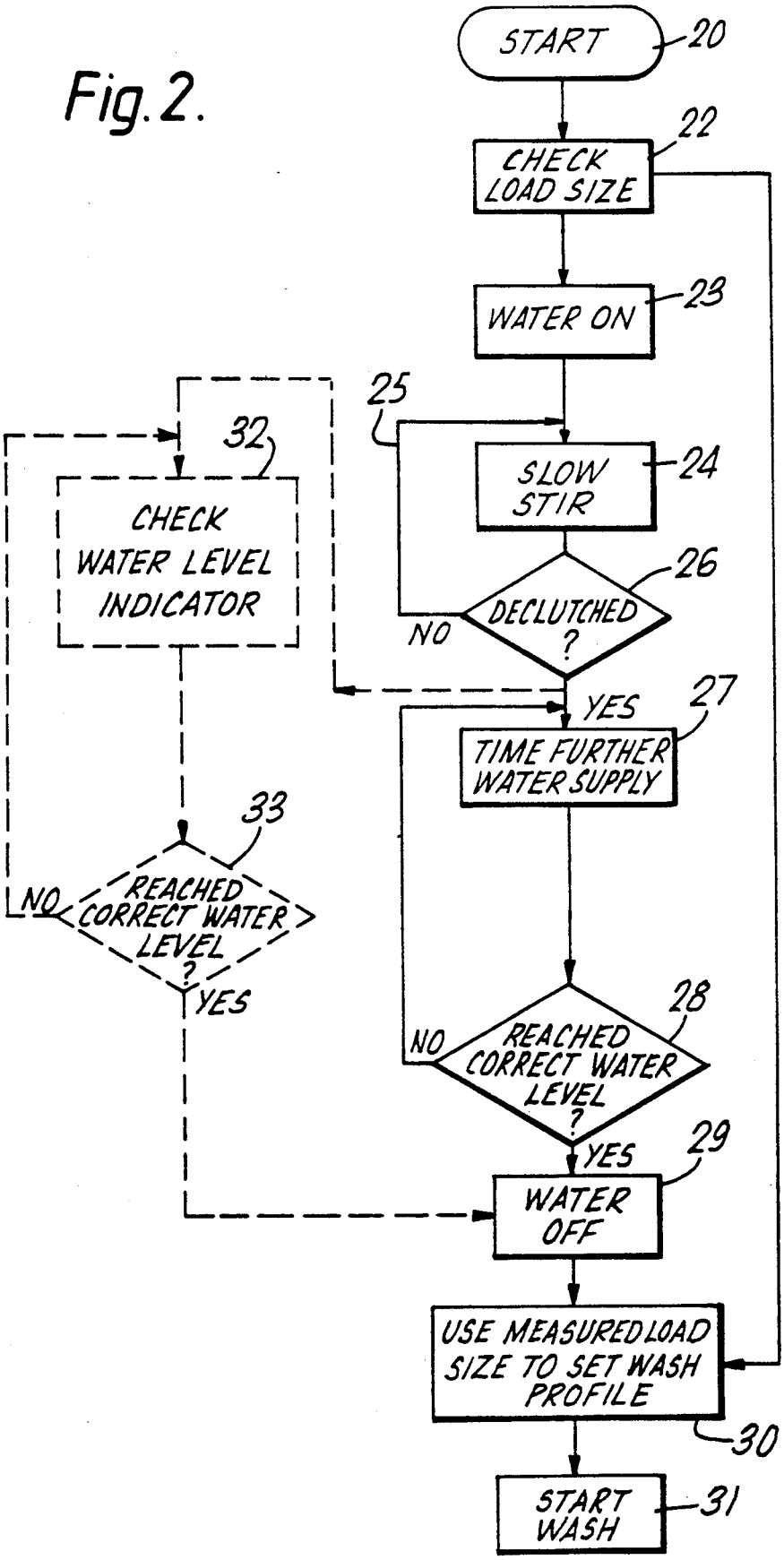
FIG. 2 is a flow chart of one form of control means incorporated in the laundry machine of FIG. 1.

In one form of the invention relating to a first control method, the control equipment includes a microprocessor programmed in accordance with a flow chart shown in FIG. 2, and referring to that flow chart, the operator operates the appropriate controls in the console 16 such that the microprocessor enters the flow chart at the start, block 20. The microprocessor causes the agitator and spin tub to rotate to a suitable speed e.g. approximately 100 rpm and the supply of powe to the motor is controlled by the microprocessor to provide such a speed. Thus a certain amount of energy is imparted to the motor rotor, spin tub, and agitator which together comprise the rotatable assembly of the washing machine, and which, with the load of clothes, provide the initial resistence to rotation. Thus energy is imparted to the clothes in the spin tub. Changes in the velocity of the rotatable assembly correspond to changes in kinetic energy of the rotatable assembly and clothes load. Therefore if electrical energy is provided to the motor such that a certain velocity (and rotational kinetic energy) is attained, the time taken for the motor to coast to zero velocity will be a measure of the mass of the rotatable assembly and the load of clothes in the spin tub. The changes or rates of change of kinetic energy of the spin tub and contents are a measure of the mass of clothes therein. In FIG. 2 the load size is determined at block 22 before water is supplied to the washing container.

Figure 5:
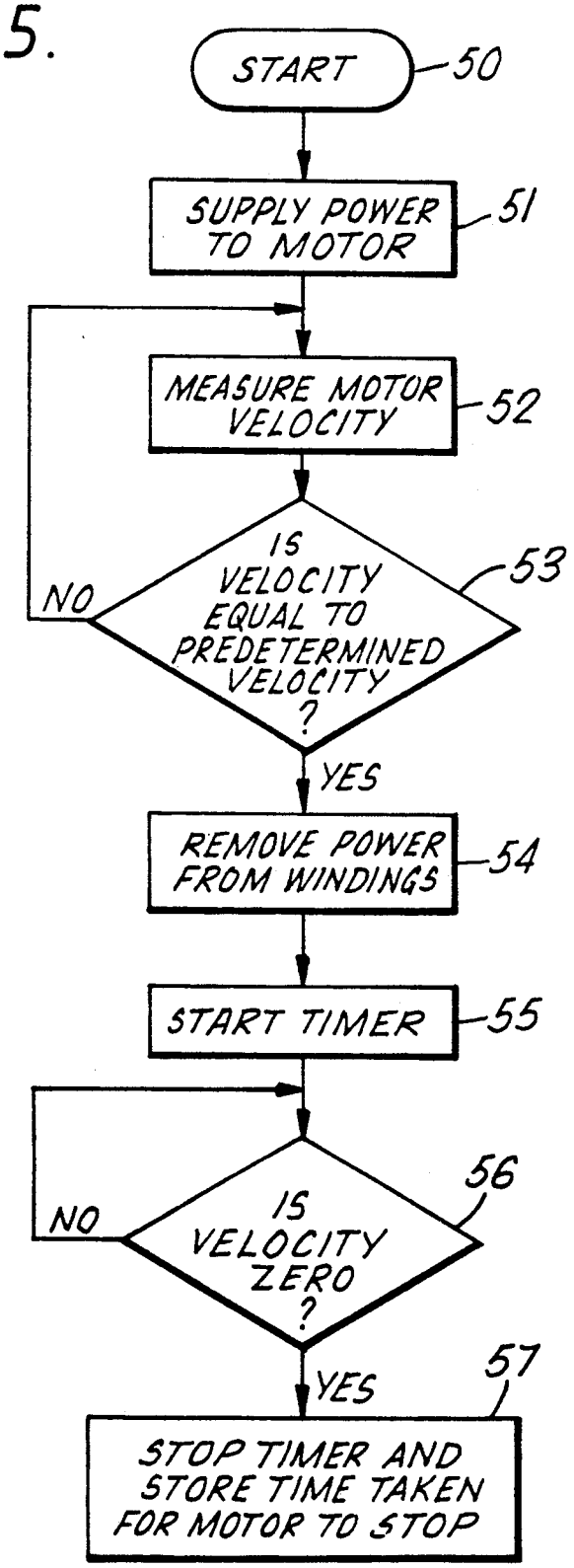
FIG. 5 is a flow chart of a part of the control means of FIGS. 2 to 4.

Referring now to FIG. 5 which is a flow chart applicable for all three methods. This figure is a flow chart showing the steps involved in the preferred form of load determination according to the present invention.

The method of FIG. 5 determines the changes in kinetic energy of the rotatable assembly comprising the motor, drive shaft, interconnecting means, spin tub, agitator and clothes by supplying a minimum amount of energy to the motor such that the rotatable assembly approximates a predetermined velocity e.g. 40 rpm. The motor and motor controls referred to in the specification are of the same form as those described in the specification of our New Zealand patent application No. 213489/213490 filed 16 Sep. 1985, (U.S. Pat. No. 4,857,814) which is incorporated herein by reference. The predetermined velocity is stored in an information storage means comprising a memory of the microprocessor which controls the motor and is compared with the instantaneous velocity of the motor, which as described in the above U.S. Pat. No. 4,857,814 is constantly calculated by the microprocessor as part of the motor control system function. The motor control system thus provides sensing means which sense the kinetic energy of the rotatable assembly and provide signals indicating the mass of the rotatable assembly and the rotatable contents (clothes load) thereof to the microprocessor. To enable the rotatable assembly to reach the predetermined velocity the pwm period is controlled, effectively controlling the current input to the motor as it is being commutated so that the velocity of the rotatable assembly slowly increases. Referring to FIG. 5, the algorithm there illustrated begins at the start block 50. Power is supplied to the motor winding stages at block 51, as described above. It has been found that supplying a minimal amount of energy to the rotatable assembly is desirable, since large amounts of energy in the rotatable assembly mean measurements take a longer time to obtain. When power is supplied to the motor windings, the velocity of the motor and rotatable assembly is then monitored by the motor controller at block 52. A predetermined motor velocity e.g. 40 rpm is stored in the memory of the microprocessor and this predetermined velocity is compared at block 53 with the instantaneous motor velocity measured in block 52. When the motor velocity is equal to the predetermined motor velocity, power is removed from the windings and a timer begins at blocks 54 and 55. At this stage the motor velocity is still being measured. After power is removed from the windings the motor speed will gradually decrease until it eventually stops. The point at which the motor velocity reaches zero is determined at block 56 and at this point the timer is stopped at block 57 and the elapsed time is stored in the memory of the microprocessor. This cycle is repeated, the motor being energized and deenergized intermittently.

Figure 6:
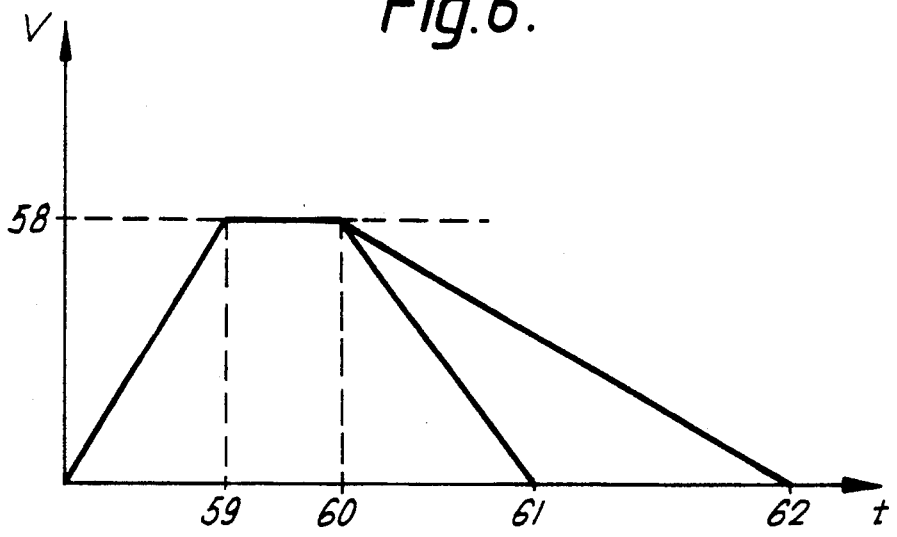
FIGS. 6 and 7 are graphs of rotational velocity vs time of the rotatable assembly of the laundry machine of FIG. 1.

Referring now to FIG. 6 a graph of velocity vs time is shown, the origin representing the point at which the motor velocity is zero, before power is applied to the motor windings. The point 58 on the vertical velocity axis represents the predetermined velocity and the point 59 on the horizontal time axis is a measure of the time taken to reach the predetermined velocity. When the rotatable assembly reaches the predetermined velocity 58 the pwm period is adjusted by means of the motor control system such that the predetermined velocity is maintained. The period for which this is maintained is shown as the time between points 59 and 60 in FIG. 6. The points 59 and 60 could be substantially coincidental. The motor is then turned off at time 60 and allowed to coast. As soon as power is removed from the motor windings a timer is activated in the microprocessor and the back emf induced in the motor windings or the output of hall effect sensors mounted o the stator is monitored, so that the speed of rotation of the motor is known. When the rotatable assembly stops rotating the timer in the microprocessor records the time taken for the motor to decelerate to zero. This time may be for example, time 61 or 62 shown in FIG. 6 and this time is representative of the inertia of the rotatable assembly. For example, if there is a large mass of clothes in the spin tub then the inertia of the rotatable assembly will be greater and the time taken for the rotational velocity of the rotatable assembly to reach zero will be significantly longer than the time taken if the spin tub had no clothes therein, for example. Since at this point in th wash cycle the agitator and spin tub are interconnected and the inertia of this apparatus is constant, the only factor which will change the time taken for the motor speed to ramp down will be the load of clothes in the spin tub and therefore the load is known.

However, due to some spurious variables such as the changing position of the clothes within the spin tub, any one reading of the time taken for the speed of the motor to reach zero will not necessarily be precisely representative of the load of clothes in the spin tub. Therefore it has been found that a number of readings e.g. at least one reading in each direction of rotation is desirable in order to obtain a true indication of the load of clothes in the machine. If the readings in each direction provide times which are within acceptable tolerances of each other, then these times are compared with time values stored in look up tables in the memory of the microprocessor which provide the control system with an indication of the load of clothes in the machine and therefore the water level which will be required for the wash routine for that load to commence. Once the appropriate water level is known by the control system the wash profile of agitation stroke time, desired speed of rotation and acceleration is selected in accordance with the specification of our New Zealand patent application No. 213489/213490.

Although in this form of the invention load measuring may be carried out with the load of clothes dry, the accuracy of load measurements may also be increased by dampening the clothes before taking the measurements. Such dampening is effected by rotating the spin tub slowly while spraying water from the outlet of valve 17 over the clothes in the spin tub.

Once the load size check has been carried out at block 22 of FIG. 2 the microprocessor causes valve 17 to be opened by a signal from the "water on" block 23. Slow stirring with reversals or with intermittent supply of power is carried on at block 24 as has been described above. At this point the load comprises clothes and water. The change in kinetic energy is continuously checked as shown by the circuit 25 containing the slow stir routine at 24. The declutch and disconnection of the agitator 4 from the spin tub 3 is detected by the air chamber or float 5 interrogation at 26. The spin tub and the agitator are connected together by the mechanism 13 and initially a relatively large inertia is present in the associated spin tub agitator and load of clothes. The inertia of the rotatable assembly and load is measured as a change in kinetic energy when the power to the motor is cut off and the motor is allowed to slow to zero speed after being maintained at a predetermined velocity as described above. The water level in the container increases until the float 5 floats the spin tub upwardly in a manner such as to disconnect the interconnecting means between the agitator and the spin tub. When this disconnection occurs there is a sudden decrease in the inertia of the rotatable assembly which is detected by the sensing means. Referring again to FIG. 6, the disconnection is seen by the sensing means as a sudden decrease in the time taken for the rotatable assembly to decelerate from the predetermined velocity to zero. The time taken for the rotatable assembly to decelerate after disconnection may for example be only one tenth that taken prior to disconnection. Thus the time between points 60 and 62 in FIG. 6 may represent the time taken for the rotatable assembly to decelerate when the spin tub and agitator are interconnected and the time between points 61 and 60 may represent the time taken for the rotatable assembly to decelerate after declutching has occurred. Thus it can be seen that there is a clear indication provided to the sensing means that disconnection has occurred.

It should be noted that the time taken for the rotatable assembly to accelerate to the predetermined speed may also be used as an indication of the inertia of the rotatable assembly and water and clothes therein. The change in the time required to accelerate the rotatable assembly is not shown in FIG. 6 in order to simplify the diagram.

Figure 7:
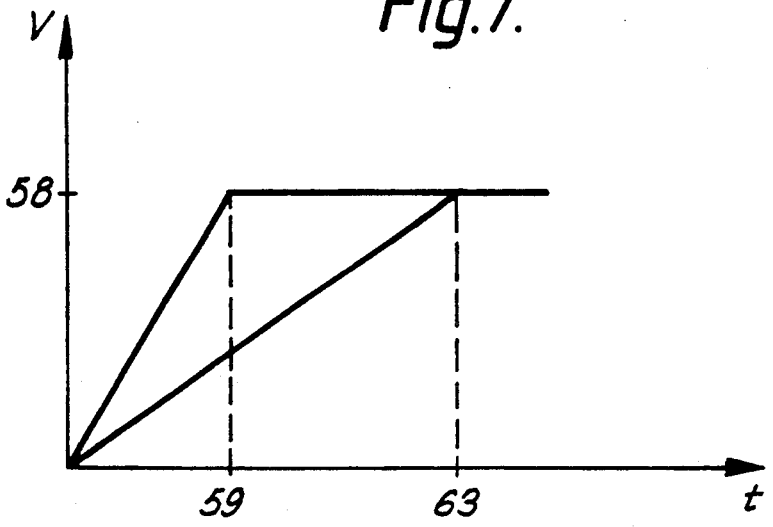

Referring now to FIG. 7, the time required for the rotatable assembly of clothes load to reach the predetermined velocity 58 prior to disconnection is the time between the origin and point 63. If the same torque is applied to the motor after disconnection the time taken to reach velocity 58 is that between the origin and point 59. Again the disconnection of the spin tub from the agitator is sensed, the signal change indicated to the control means where, by reference to the look up tables, a water level for the load is selected. The ramp down times are not shown for simplicity.

Thus when declutching occurs a further timer commences operation, allowing the water supply to remain on for a desired water on overrun time, which is either a predetermined period, or is of say 10–20% of the time to fill the container 2 to declutch. The water on overrun time is operated in block 27 and when that time has elapsed at block 28 the "water off" signal operates at 29 causing valve 17 to close. The load measured from block 22 indicates the washing profile at block 30 and washing started at block 31. The washing profile control is described in the specification of our New Zealand patent application No. 213489/213490.

Thus in this first method the water level is determined by adding water after declutching for a period of time which is either a proportion of the time to fill to declutching or a fixed further period of time dependent on the sensed load in the machine. Referring again to FIG. 1, water pressure indicator 18 senses pressure of water in the base of the washing container and therefore also provides an indication of the water level in the container 2. If the pressure indicator 18 is present, the routine to time further water supply in block 27 is not necessary and a branch may be taken from block 26 to block 32 (dashed lines) which checks the water level indicator and compares this at block 33 with the desired water level which has been obtained from look up tables relating to the load size stored in information storage means which comprise the memory of the microprocessor. If the correct water level has been reached the water off block is returned to at 29, the wash profile is set by reference to the look up tables and the wash begins.

Although the load of clothes in the spin tub may be sensed before water is added to the spin tub by the method previously described, a second method of determining the load of clothes in the spin tub is to start the washing machine motor from a stand still as previously described but in addition, substantially simultaneously or earlier admitting water to the container, increasing the rotational velocity of the motor up until a predetermined velocity is obtained and then measuring the time taken for the rotational velocity to drop to zero, as the water is being allowed to enter the washing container. When a certain known quantity of water is present in the container, float 5 will rise and the spin tub will be disconnected from the agitator such that the spin tub is stationary. As with the first method since the spin tub comprises a significant proportion of the mass of the rotatable assembly, the inertia of the assembly will suddenly decrease and after the predetermined velocity is reached, the time taken for the rotatable assembly to come to a halt will suddenly decrease by a significant time period. The microprocessor has in its memory a figure representative of a sufficiently large time period such that if the measured time period decreases by an amount which is equal to or greater than the value stored in a memory of the microprocessor, the microprocessor will signal that disconnection of the spin tub from the agitator has occurred. The amount of water necessary for disconnection to occur will vary depending on the load of clothes in the spin tub. The microprocessor has stored the time value indicative of the total load of the rotatable assembly from the last iteration prior to disconnection. Thus the load of clothes and water in the machine is known just prior to disconnection. Since the time from when water was first introduced to the container to the time at which disconnection occurs is a relative measure of the load of clothes in the spin tub depending on the rate of water flow into the machine, the microprocessor may now refer to a look up table in order to obtain a value of the time required to fill the container to a desired water level. The look up table in the microprocessor provides a further "water on" time after disconnection which is a percentage overrun time based on the time taken to fill the container to declutch.

Figure 3:
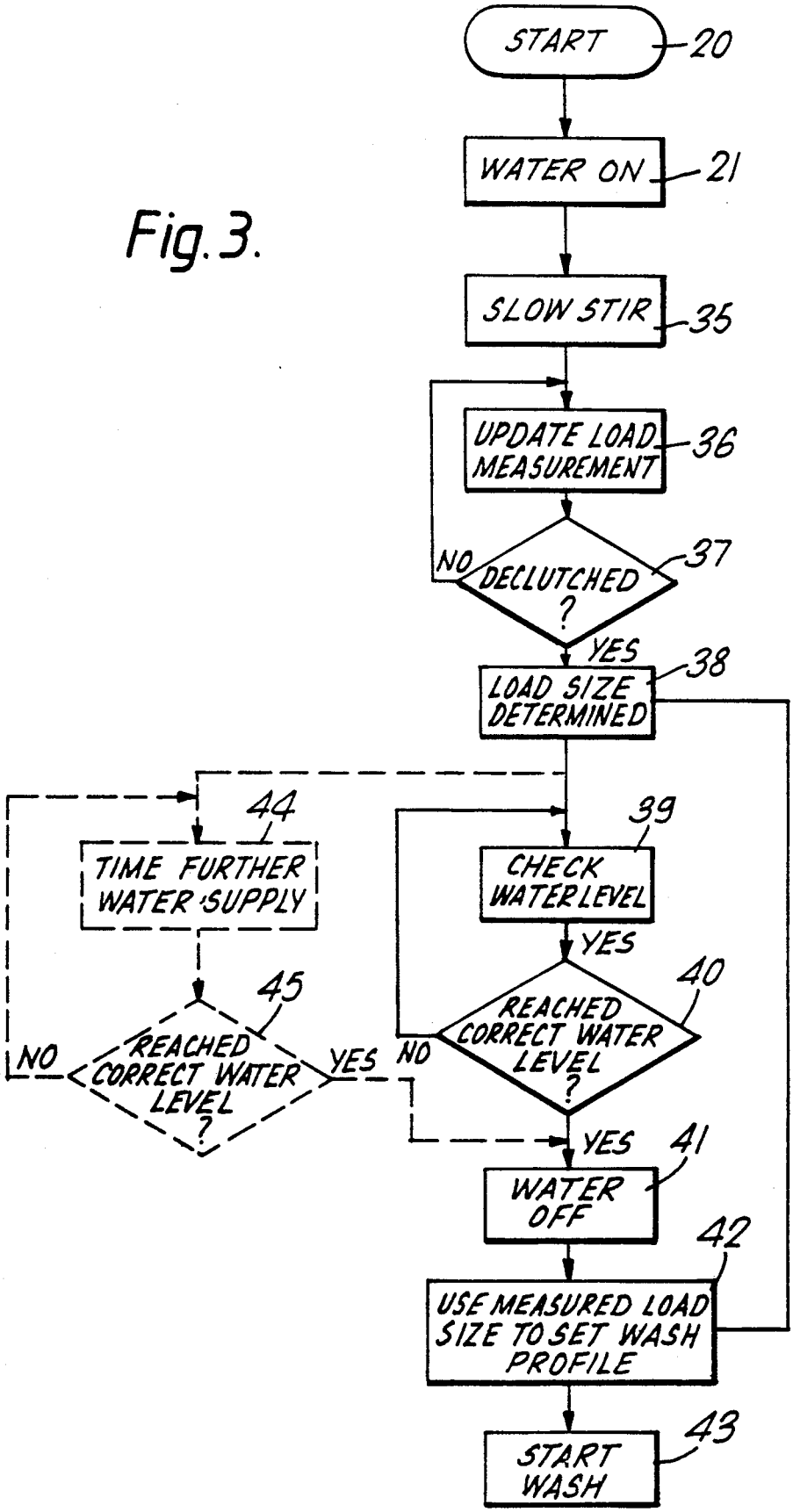
FIG. 3 is a flow chart of a further embodiment of control means in accordance with the invention.

In the routine of FIG. 3, as stated above, operating the controls causes a routine to start at 20 and the microprocessor causes the valve 17 to be opened by a signal from the "water on? block 21. Before load measurement begins the spin tub may be rotated slowly such that the outlet of valve 17 sprays water on top of the clothes in the container in order to ensure that the clothes are uniformly wet before load measurement begins. In addition slow stirring is commenced by a signal from block 35, such slow stir including acceleration and deceleration sequences during which there are changes in kinetic energy and the speed changes and the mass of the load can be indicated by sensing means which sense the changes in kinetic energy over a predetermined time or between predetermined speeds. As explained above with reference to FIGS. 5 and 6, signals indicating the changes in kinetic energy are then passed from block 36. The spin tub and the agitator are connected together by the mechanism 13 and initially a relatively large inertia is present in the associated spin tub agitator and load of clothes. This inertia is measured for example as a change in kinetic energy when the power to the motor is cut off and allowed to slow to zero speed as previously described. The water level in the container increases, until the float 5 floats the spin tub upwardly in a manner such as to disconnect the interconnecting means between the agitator and spin tub. At this point there is a sudden decrease in the inertia of the rotatable assembly and this decrease in inertia is detected by the sensing means and instead of the microprocessor indicating that the slow stir is to continue, causes at 37 a signal to be passed by block 36 indicating that disconnection has occurred as indicated by the block 38. The momentum or kinetic energy signal reached in the final stages before declutching is recorded at block 38 and is passed to block 42. The mass of the clothes load in the spin tub has been found by experiment to be directly proportional to the quantity of water required to float the spin tub. The water or washing liquid is supplied to the container at fixed rate and therefore the time between turning the water valve "on" and disconnection is also an indication of the load of clothes in the container. Since the water level at disconnection is known from pressure indicator 18 the load of clothes is known and the control means can supply the appropriate water level for washing. If water pressure indicator 18 is not present the mass of the clothes load and the desired washing water level may be calculated by the control means eg. by the look up tables in the microprocessor since the relationship between water level at disconnection and clothes load is known and the total load of water and clothes is known at disconnection. The operator will have selected a desired degree of vigorousness of wash and this vigorousness is affected by the momentum of the spin tub, agitator, clothes and water contained at the declutch level. Accordingly a desired rotary stroke of the agitator during washing is set up according to the momentum figure stored in block 42 as is described in New Zealand patent specification No. 213489/213490.

Once disconnection or declutching has occurred according to signals from block 36, (and the timing of such disconnection depends on the size of the clothes load) the microprocessor continues to check the load which is still influenced by the filling of water into the container 2 as is indicated in block 39 and the microprocessor determines at block 40 as to whether a desired water level and load measurement has been reached. This is achieved by means of the water pressure indicator 18 from which the microprocessor has determined the water level at disconnection. Knowing the water level at this point means that the load of clothes in the spin tub is known and the microprocessor then refers to a look up table to determine the desired water level. The water level may then be monitored by checking the pressure indicator at block 39. Also, once the time to declutch is known the correct water level may be reached by timing the further water supply as shown in the block 44 with dashed lines, this time being an empirically decided percentage overrun time from the time taken for declutch to occur. When the correct water level has been reached in block 45 the water valve 17 is turned off in block 41 and the wash begins in block 43.

Figure 4:
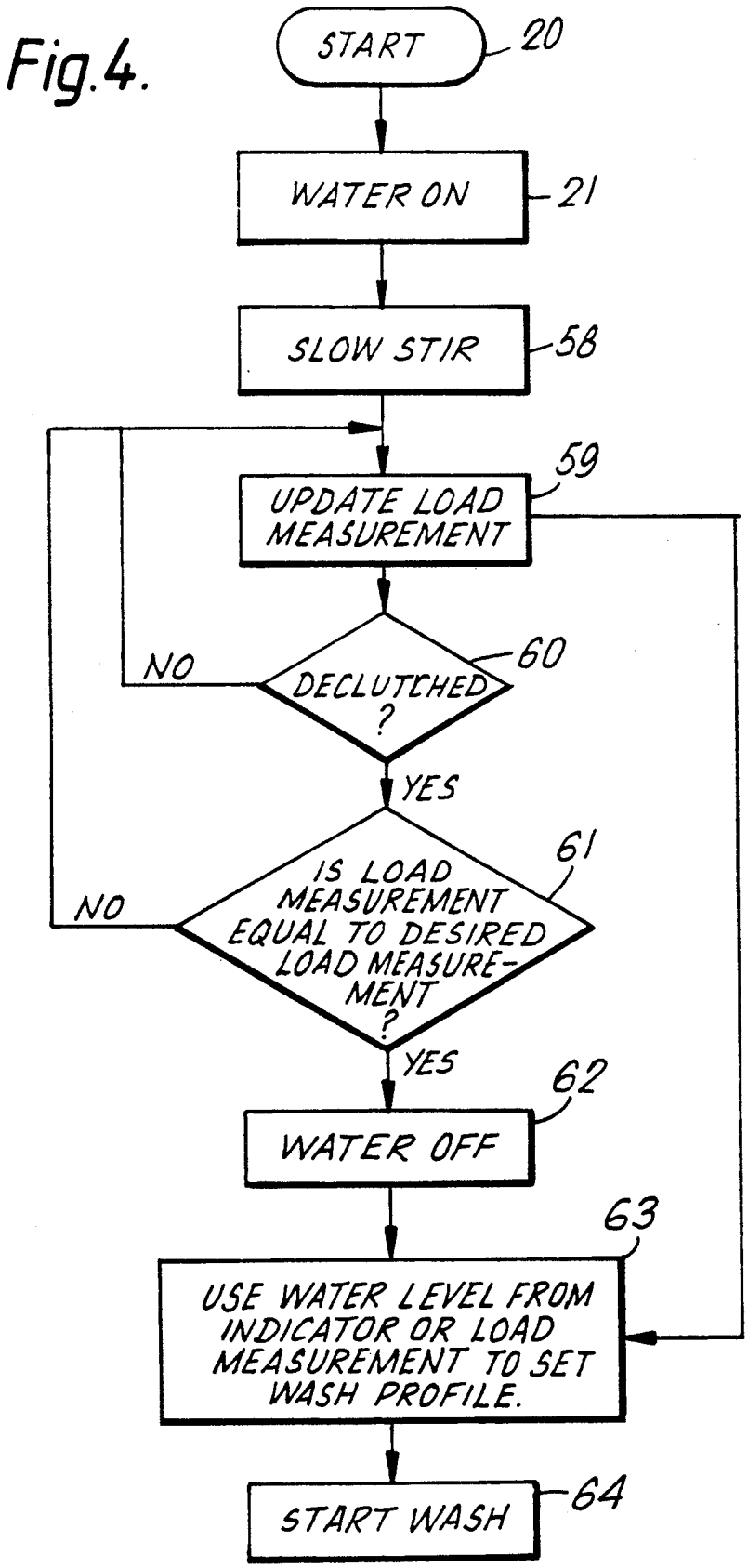
FIG. 4 is a flow chart of a further embodiment of control means in accordance with the invention.

Referring now to FIG. 4, a third method of determining the load in the washing machine is shown. As with FIGS. 2 and 3 the routine starts at block 20 and water is turned on at block 21. The slow stir with changes in speed of the rotatable assembly and corresponding changes in kinetic energy as described with reference to FIGS. 5 and 6 is initiated in block 58. The load measurement is updated in block 59 and declutching is detected in block 60. When the water is turned on in block 21 and before the slow stir begins in block 58 the spin tub is rotated slowly for a brief period so that the water coming in through valve 17 is sprayed onto the clothes in the spin tub to ensure that the clothes are substantially uniformly wet before load measurements are taken. Thus initially, there are wet clothes about the agitator and between the agitator and the walls of the spin tub. When disconnection occurs there will be some water in the container 2 and there will still be clothes between the agitator and the spin tub such that the agitator movement is restricted by the clothes. As more water is introduced into the container, the clothes in the spin tub will begin to float free from the agitator and thus the increased water in the container reduces the friction between the agitator and the walls of the spin tub. Therefore if the agitator is rotated to a certain low velocity and power is removed from the motor, allowing the motor and agitator to coast, the time taken for the agitator to reach zero velocity will gradually increase as more water is introduced into the container. Therefore the measurements that began as measurements of the mass of the rotatable assembly, clothes and water before disconnection become measurements of the friction between the agitator and spin tub due to the clothes and water in the container. These measurements may also be thought of as measurements of the "viscosity" of the mixture of clothes and water in the washing container. When the time taken for the agitator to reach zero velocity is sufficiently long then the optimum water level has been reached for good wash performance. The load measurement on the agitator is compared with the optimum stored in the microprocessor at block 61 and if the load measurement is satisfactory the water valve 17 is switched off at block 62. The load measurement obtained in block 59 may be passed to block 63 to give a measure of the load size to set the initial wash profile. Alternatively, the water pressure indicator 18 may be monitored in order to determine the water level reached and from this water level the desired initial wash profile may be determined. The wash then begins in block 64.

After the washing container has been filled to the desired level and before the wash begins the clothes in the washing container will often have a number of air bubbles therein and when agitation begins these will be expelled and the water level in the container may drop significantly. Therefore in each of the methods described, in machines which are provided with a water pressure indicator 18, before the wash is started the agitator is rotated back and forth a small number of strokes in order to expel the air trapped in the clothes in the spin tub. Once the air is removed the water valve 17 is turned on again in order to refill the water container 2 to the desired level.

From the foregoing it will be seen that methods of providing an optimum water level for a load of clothes in a washing machine are provided which are performed automatically by the machine without any necessary information or decisions being supplied by the operator, other than decisions regarding vigourousness of wash.

We claim:

1. A method of providing a desired level of washing liquid in a laundry machine having a cabinet, a washing contianer within said cabinet, a rotatable assembly including a spin tub within said container and an agitator within said spin tub, a motor driving said agitator conjointly with said spin tub or separately on disconnection of said spin tub from said agitator as required, and washing liquid level control means to control washing liquid level in said washing container, the method comprising:

placing a load of clothes in said spin tub; initiating the supply of washing liquid to said container and energizing said motor intermittently to produce changes in the rotational speed of said rotatable assembly as washing liquid is being supplied to said container; sensing the changes in speed of said rotatable assembly relative to energy input to said motor with a sensing means; passing signals indicative of the total rotating mass of said rotatable assembly including the washing liquid in said container and the clothes in said spin tub from said sensing means to said liquid level control means; determining the point of disconnection of said spin tub from said agitator dependent on said signals with said control means, said signals passed from said sensing means to said control means at the time of disconnection being indicative of the mass of said load of clothes; determining said desired level of liquid washing with said control means from said signals at the time of disconnection, said desired level being dependent on the mass of the load of clothes; controlling the supply of further washing liquid to said container to said desired level with said control means; and causing continuous washing action to commence when said desired level is reached.

2. A method as claimed in claim 1 wherein:

sensing said total rotating mass of said rotatable assembly comprises controlling the supply of power to said motor with said control means so that said rotatable assembly is accelerated to a desired rotational velocity; removing power from the motor; measuring the time taken for the rotatable assembly to attain zero rotational velocity, said time indicating total rotating mass, said time being passed to said control means as said signal; and repeating said steps to obtain further time measurements as required.

3. A method as claimed in claim 1 wherein:

sensing said total rotating mass of said rotatable assembly comprises controlling the supply of power to said motor with said control means so that said rotatable assembly is accelerated to a desired rotational velocity; measuring the time taken for the rotatable assembly to attain said desired velocity, said time indicating said total rotating mass; passing said time to said control means as said signal; and repeating said steps to obtain further time measurements as required.

4. A method as claimed in claim 1 and further comprising:

storing information of the mass of the load of clothes in information storage means after sensing the load of clothes in the spin tub and using the stored information to provide routines selected from giving an indication of a wash profile of agitation stroke times, desired speed of rotation and acceleration requested for the sensed selected load of clothes to be washed and to control the washing routine to give a desired degree of wash to the clothes.

5. A method as claimed in claim 1 and further comprising:

rotating said container slowly in one direction and supplying a desired quantity of washing liquid to said container before energizing said motor intermittently so that said load of clothes is damp before intermittent energization of said motor.

6. A method as claimed in claim 1 and further comprising:

commencing a gentle wash agitation of the clothes for a predetermined time after said control means have supplied washing liquid to said container to said desired level;

stopping said gentle wash agitation;

detecting the washing liquid level in said container; and if said washing liquid level is below said desired level, supplying further washing liquid to said container so that said washing liquid level becomes said desired level, and when said washing liquid is at said desired level, causing continuous washing action to commence.

7. A method as claimed in claim 1 and further comprising:

measuring the time taken to supply the level of washing liquid necessary for disconnection of said agitator from said spin tube; and effecting the supply of further washing liquid to said container by said control means dependant on timing means which time the supply of further washing liquid to said container as a proportion of the time taken for the level of washing liquid necessary for disconnection.

8. A method as claimed in claim 1 and further comprising:

effecting the supply of further washing liquid to said container by said control means dependent on auxiliary washing liquid detection means which detect the level of washing liquid in said container.

9. Control means for a laundry machine having a cabinet, a washing container within said cabinet, a rotatable assembly comprising a spin tub within said container and an agitator within said spin tub, disconnecting means for disconnecting said spin tub from said agitator for spinning action when required, a motor driving said agitator conjointly with said spin tub and separately on disconnection of said spin tub from said agitator as required, and washing liquid admission means, said control means comprising; sensing means to sense the changes in speed of said rotatable assembly including the mass of clothes load in said assembly relative to energy input to said motor; and washing liquid level control means arranged to control washing liquid level in said washing container in response to signals passed by said sensing means to said washing liquid level control means, the construction and arrangement being such taht said sensing means pass signals indicative of the total mass of said rotatable assembly including the washing liquid in said container and at least the clothes in said spin tub to said washing liquid level control means so taht said washing liquid level control means detect the point of disconnection of said spin tub from said agitator in response to said signals, said signals passed including a disconnection signal indicating the point of disconnection of said spin tub from said agitator and being indicative of the mass of said load of clothes, and so that upon detection of said disconnection, said control means also determine a desired washing liquid level dependent on said disconnection signal and control the supply of further washing liquid to said container to control the level of washing liquid to said desired level which is dependent on the mass of clothes load sensed by said sensing means and cause continuous washing action to start when said desired level is reached.

10. Control means as claimed in claim 9 and further comprising:

means for sensing said total rotating mass of said rotatable assembly by controlling the supply of power to said motor so that said rotatable assembly is accelerated to a desired rotational velocity, power is removed from the motor, the time taken for the rotatable assembly to attain zero rotational velocity is measured, said time indicating said total rotating mass, and said time is passed to said washing liquid level control means as said disconnection signal.

11. Control means as claimed in claim 9 and further comprising:

means for sensing said total rotating mass of said rotatable assembly by controlling the supply of power to said motor so that said rotatable assembly is accelerated to a desired rotational velocity; and timing means for measuring the time taken for the rotatable assembly to attain said desired velocity, said timing means indicating said total rotating mass and passing said time to said washing liquid level control means as said disconnection signal.

12. Control means as claimed in claim 9 and further comprising:

information storage means for storing of information of the mass of the load of clothes responsive to said signals and using the stored information to provide routines selected from giving an indication of a wash profile of agitation stroke times, desired speed for rotation and acceleration required for the sensed selected load of clothes to be washed and to control the washing routine to give a desired degree of wash to the clothes.

13. Control means as claimed in claim 9 and further comprising:

means for rotating said container slowly in one direction and supplying a desired quantity of washing liquid to said container before energizing said motor intermittently so that said load of clothes is damped before intermittent energization of said motor.

14. Control means as claimed in claim 9 and further comprising:

means for commencing a gentle wash agitation of the clothes for a predetermined time after said washing liquid has been supplied to said container to said desired level; stopping said gentle wash agitation; detecting the washing liquid level in said container; and if said washing liquid level is below said desired level supplying further washing liquid to said container so that said washing liquid level becomes said desired level, and when said washing liquid is at said desired level, causing continuous washing action to commence.

15. Control means as claimed in claim 9 and further comprising:

means to measuare the time taken for supply of the level of washing liquid necessary for disconnection of said agitator from said spin tub and the supply of further washing liquid to said container effected by said washing liquid level control means dependent on timing means which time a supply of further washing liquid to said container as a proportion of the time taken for the level of washing liquid necessary for disconnection.

16. Control means as claimed in claim 9 wherein:

auxiliary washing liquid level detection means are also provided, said washing liquid level control means effecting the supply of further washing liquid to said container dependent on said auxiliary washing liquid level detection means.

17. Control means as claimed in claim 9 further comprising:

means for sensing said total rotating mass of said rotatable assembly and causing a predetermined level of power to be supplied to said motor for a predetermined time to thereby cause the rotatable assembly to acceleralte from an initial known velocity to a final velocity, and for determining the velocity difference from which a signal indicative of the total rotating mass is passed to said washing liquid level control means as said disconnection signal.

18. A laundry machine comprising:

a cabinet; a washing container within said cabinet; a rotatable assembly comprising a spin tub within said container and an agitator within said spin tub; disconnecting means for disconnecting said spin tub from said agitator for spinning action when required; a motor driving said agitator conjointly withi said spin tub and separately on disconnection of said spin tub from said agitator as required; control means comprising sensing means to sense the changes in speed of said rotatable assembly including the mass of clothes load in said assembly relative to energy input to said motor; and washing liquid level control means arranged to control washing liquid level in said washing container in response to signals passed by said sensing means to said washing liquid level control means; the construction and arrangement being such that said sensing means pass signals indicative of the total mass of said rotatable assembly including the washing liquid in said container and at least the clothes in said spin tub to said washing liquid level control means so that said washing liquid level control means detect the point of disconnection of said spin tub from said agitator in response to said signals, said signals passed including an disconnection signal indicating the point of disconnection of said spin tub from said agitator and being indicative of the mass of said load of clothes, and so that upon detection of said disconnection, said control means also determine a desired washing liquid level dependent on said disconnection signal and control the supply of further washing liquid to said container to control the level of washing liquid to said desired level which is dependent upon the mass of clothes load sensed by said sensing means and causes continuous washing action to start when said desired level is reached.

19. A laundry machine as claimed in claim 18 wherein:

said control means further comprises means for sensing said total rotating mass of said rotatable assembly by controlling the supply of power to said motor so that said rotatable assembly is accelerated to a desired rotational velocity, removing power from the motor, measuring the time taken for the rotatable assembly to attain zero rotational velocity, said time indicating said total rotating mass, and passing said time to said washing liquid level control means as said disconnection signal.

20. A laundry machine as claimed in claim 18 wherein:

said control means further comprises means for sensing said total rotating mass of said rotatable assembly by controlling the supply of power to said motor so that said rotatable assembly is accelerated to a desired rotational velocity, measuring the time taken for the rotatable assembly to attain said desired velocity, said timer indicating said total rotating mass, and passing said time to said washing liquid level control means as said disconnection signal.

21. A laundry machine as claimed in claim 18 and further comprising:

information storage means for storing of information of the mass of the load of clothes responsible to said signals and using the stored information to provide routines selected from giving an indication of a wash profile of agitation stroke times, desired speed of rotation and acceleration required for the sensed selected load of clothes to be washed and to control the washing routine to give a desired degree of wash to the clothes.

22. A laundry machine as claimed in claim 18 and further comprising:

means for rotating said container slowly in one direction and supplying a desired quantity of washing liquid to said container before energizing said motor intermittently so that said load of clothes is damp before intermittent energization of said motor.

23. A laundry machine as claimed in claim 18 and further comprising:

means for commencing a gentle wash agitation of the clothes for a predetermined time after said washing liquid has been supplied to said container to said desired level; stopping said gentle wash agitation; detecting the washing liquid level in said container; and if said washing liquid level is below said desired level, supplying further washing liquid to said container so that said washing liquid level becomes said desired level, and when said washing liquid is at said desired level, causing continuous washing action to commence.

24. A laundry machine as claimed in claim 18 and further comprising:

means to measure the time taken for supply of the level of washing liquid necessary for disconnection of said agitator from said spin tub and the supply of further washing liquid to said container effected by said washing liquid level control means dependent on timing means which time the supply of further washing liquid to said container as a proportion of the time taken for the level of washing liquid necessary for disconnection.

25. A laundry machine as claimed in claim 18 wherein:

an auxiliary washing liquid level detection means is provided, said washing liquid level control means effecting the supply of further washing liquid level detection means.

26. A laundry machine as claimed in claim 18 wherein:

said control means further comprises:

means for sensing said total rotating mass of said rotatable assembly and causing a predetermined level of power to be supplied to said motor for a predetermined time to thereby cause the rotatable assembly to accelerate from an initial known velocity to a final velocity, and for determining the velocity difference from which a signal indicative of the total rotating mass is passed to said washing liquid level control means as said disconnection signal.

* * * * *